US009157041B2

(12) United States Patent
Reid

(10) Patent No.: US 9,157,041 B2
(45) **Date of Patent: *Oct. 13, 2015**

(54) FUEL COMPOSITIONS

(75) Inventor: Jacqueline Reid, Cymau Flintshire (GB)

(73) Assignee: Innospec Limited (GB)

( * ) Notice: Subject to any disclaimer, the term of this patent is extended or adjusted under 35 U.S.C. 154(b) by 448 days.

This patent is subject to a terminal disclaimer.

(21) Appl. No.: 12/679,746

(22) PCT Filed: Sep. 25, 2008

(86) PCT No.: PCT/GB2008/050864

§ 371 (c)(1),
(2), (4) Date: May 27, 2010

(87) PCT Pub. No.: WO2009/040582

PCT Pub. Date: Apr. 2, 2009

(65) Prior Publication Data

US 2010/0299992 A1 Dec. 2, 2010

(30) Foreign Application Priority Data

Sep. 27, 2007 (GB) ..... 0718858.4
May 9, 2008 (GB) ..... 0808404.8

(51) Int. Cl.

| | |
|---|---|
| ***C10L 1/18*** | (2006.01) |
| ***C10L 1/238*** | (2006.01) |
| ***C10L 1/22*** | (2006.01) |
| ***C10L 1/222*** | (2006.01) |
| ***C10L 1/2387*** | (2006.01) |
| ***C10L 10/00*** | (2006.01) |
| ***C10L 10/18*** | (2006.01) |
| *C10L 1/228* | (2006.01) |
| *C10L 1/2383* | (2006.01) |

(52) U.S. Cl.

CPC . *C10L 1/238* (2013.01); *C10L 1/22* (2013.01); *C10L 1/221* (2013.01); *C10L 1/2225* (2013.01); *C10L 1/2387* (2013.01); *C10L 10/00* (2013.01); *C10L 10/18* (2013.01); *C10L 1/2283* (2013.01); *C10L 1/2383* (2013.01)

(58) Field of Classification Search

CPC ..... C10L 1/221; C10L 1/223; C10L 1/238; C10L 10/00; C10L 1/22; C10L 1/2225; C10L 1/2387; C10L 10/18

USPC ..... 44/415, 425

See application file for complete search history.

(56) References Cited

U.S. PATENT DOCUMENTS

| | | | |
|---|---|---|---|
| 2,812,342 | A | 11/1957 | Peters |
| 2,962,442 | A | 11/1960 | Andress, Jr. |
| 3,110,673 | A | 11/1963 | Benoit, Jr. |
| 3,172,892 | A | 3/1965 | Le Suer et al. |
| 3,216,936 | A | 11/1965 | Le Suer |
| 3,219,666 | A | 11/1965 | Norman et al. |
| 3,250,715 | A | 5/1966 | Wyman |
| 3,251,853 | A | 5/1966 | Hoke |
| 3,260,671 | A | 7/1966 | Trites et al. |
| 3,272,746 | A | 9/1966 | Le Suer et al. |
| 3,310,492 | A | 3/1967 | Benoit, Jr. |
| 3,326,801 | A | 6/1967 | Schlobohm et al. |
| 3,337,459 | A | 8/1967 | Ford |
| 3,341,542 | A | 9/1967 | Le Suer et al. |
| 3,405,064 | A | 10/1968 | Miller |
| 3,429,674 | A | 2/1969 | Hoke |
| 3,437,583 | A | 4/1969 | Gonzalez |
| 3,444,170 | A | 5/1969 | Norman et al. |
| 3,455,831 | A | 7/1969 | Davis |
| 3,455,832 | A | 7/1969 | Davis |
| 3,468,639 | A | 9/1969 | Lindstrom et al. |
| 3,576,743 | A | 4/1971 | Widmer et al. |
| 3,630,904 | A | 12/1971 | Musser et al. |
| 3,632,511 | A | 1/1972 | Liao |
| 3,778,371 | A | 12/1973 | Malec |
| 3,804,763 | A | 4/1974 | Meinhardt |
| 3,857,791 | A | 12/1974 | Marcellis et al. |
| 4,171,959 | A | 10/1979 | Vartanian |
| 4,234,435 | A | 11/1980 | Meinhardt |
| 4,253,980 | A | 3/1981 | Hammond et al. |
| 4,326,973 | A | 4/1982 | Hammond et al. |
| 4,338,206 | A | 7/1982 | Hammond et al. |
| 4,396,517 | A | 8/1983 | Gemmill, Jr. et al. |
| 4,501,595 | A | 2/1985 | Sung et al. |
| 4,894,139 | A | 1/1990 | Roling et al. |
| 5,039,307 | A | 8/1991 | Herbstman et al. |
| 5,122,161 | A | 6/1992 | Benfaremo et al. |

(Continued)

FOREIGN PATENT DOCUMENTS

| | | | |
|---|---|---|---|
| CA | 2 386 281 | A1 | 4/2001 |
| CA | 2359723 | A1 | 8/2001 |
| EP | 0376563 | A1 | 7/1990 |
| EP | 0 385 633 | A | 9/1990 |
| EP | 0565285 | A1 | 10/1993 |
| EP | 0 827 999 | A1 | 8/1997 |
| EP | 1 081 210 | A1 | 8/2000 |
| EP | 1132455 | A1 | 2/2001 |
| EP | 1344785 | A1 | 9/2003 |
| EP | 1411105 | A2 | 4/2004 |

(Continued)

OTHER PUBLICATIONS

International Search Report from the Patent Cooperation Treaty, date of mailing Mar. 5, 2009 from Parent PCT/GB2008/050864.

(Continued)

*Primary Examiner* — Cephia D Toomer

(74) *Attorney, Agent, or Firm* — Burns & Levinson LLP; Janine M. Susan

(57) ABSTRACT

The present invention relates to diesel fuel compositions comprising a performance enhancing additive, wherein the additive is the product of a Mannich reaction between: (a) an aldehyde; (b) a polyamine; and (c) an optionally substituted phenol; wherein the or each substituent of component (c) has an average molecular weight of less than 400.

10 Claims, No Drawings

(56) References Cited

U.S. PATENT DOCUMENTS

| | | | | |
|---|---|---|---|---|
| 5,254,138 | A | 10/1993 | Kurek | |
| 6,634,336 | B1 | 10/2003 | Kropp | |
| 6,821,307 | B2 | 11/2004 | Caprotti et al. | |
| 2002/0020106 | A1 | 2/2002 | Filippini et al. | |
| 2003/0029077 | A1 | 2/2003 | Jackson et al. | |
| 2005/0215441 | A1 * | 9/2005 | Mackney et al. | 508/291 |
| 2006/0070293 | A1 | 4/2006 | Lange et al. | |
| 2006/0277819 | A1 | 12/2006 | Puri et al. | |

FOREIGN PATENT DOCUMENTS

| | | | |
|---|---|---|---|
| EP | 1518918 | A1 | 3/2005 |
| EP | 1 705 234 | A | 9/2006 |
| EP | 1854867 | A1 | 11/2007 |
| EP | 1884556 | A2 | 2/2008 |
| EP | 1887074 | A1 | 2/2008 |
| EP | 1900795 | A1 | 3/2008 |
| GB | 2 010 324 | A | 6/1979 |
| RU | 2291186 | C1 | 1/2007 |
| WO | 90/06982 | A | 6/1990 |
| WO | 00/09634 | A | 2/2000 |
| WO | 01/25293 | A1 | 4/2001 |
| WO | 03/014267 | A | 2/2003 |
| WO | 03/078552 | A3 | 9/2003 |
| WO | 03083020 | A1 | 10/2003 |
| WO | 2008027881 | A1 | 3/2008 |

OTHER PUBLICATIONS

International Preliminary Report on Patentability, dated Apr. 8, 2010 from Parent PCT/GB2008/050864.

Search Report from the United Kingdom Intellectual Property Office, date of search, Jan. 17, 2008, from priority application GB/0718858.4.

Robert Bosch GmbH, "The Common Rail Diesel Injection System Explained," Jun. 7, 2004. Available at www.Swedespeed.com.

* cited by examiner

FUEL COMPOSITIONS

CROSS-REFERENCE TO RELATED APPLICATIONS

This application is a U.S. national stage application under 35 U.S.C. 371 of co-pending International Application No. PCT/GB08/50864 filed Sep. 25, 2008 and entitled "FUEL COMPOSITIONS", which in turn claims priority to Great Britain Patent Application No. 0718858.4 filed Sep. 27, 2007, and to Great Britain Patent Application No. 0808404.8 filed May 9, 2008, all of which are incorporated by reference herein in their entirety for all purposes.

The present invention relates to fuel compositions and additives thereto. In particular the invention relates to additives for diesel fuel compositions, especially those suitable for use in diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants with power output up to 4300 kW or engines such as the Renault dXi 7 having 6 cylinders and a power output around 240 kW. A typical passenger car diesel engine is the Peugeot DW10 having 4 cylinders and a power output of 100 kW or less depending on the variant.

In all of the diesel engines relating to this invention, a common feature is a high pressure fuel system. Typically pressures in excess of 1350 bar ($1.35\times10^8$ Pa) are used but often pressures of up to 2000 bar ($2\times10^8$ Pa) or more may exist.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurizing the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C. Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues or sticky or gum-like residues. In some situations very high additive treat rates may lead to increased deposits. Diesel fuels become more and more unstable the more they are heated, particularly if heated under pressure. Thus diesel engines having high pressure fuel systems may cause increased fuel degradation.

The problem of injector fouling may occur when using any type of diesel fuels. However, some fuels may be particularly prone to cause fouling or fouling may occur more quickly when these fuels are used. For example, fuels containing biodiesel have been found to produce injector fouling more readily. Diesel fuels containing metallic species may also lead to increased deposits. Metallic species may be deliberately added to a fuel in additive compositions or may be present as contaminant species. Contamination occurs if metallic species from fuel distribution systems, vehicle distribution systems, vehicle fuel systems, other metallic components and lubricating oils become dissolved or dispersed in fuel.

Transition metals in particular cause increased deposits, especially copper and zinc species. These may be typically present at levels from a few ppb (parts per billion) up to 50 ppm, but it is believed that levels likely to cause problems are from 0.1 to 50 ppm, for example 0.1 to 10 ppm.

When injectors become blocked or partially blocked, the delivery of fuel is less efficient and there is poor mixing of the fuel with the air. Over time this leads to a loss in power of the engine, increased exhaust emissions and poor fuel economy.

As the size of the injector nozzle hole is reduced, the relative impact of deposit build up becomes more significant. By simple arithmetic a 5 μm layer of deposit within a 500 μm hole reduces the flow area by 4% whereas the same 5 μm layer of deposit in a 200 μm hole reduces the flow area by 9.8%.

At present, nitrogen-containing detergents may be added to diesel fuel to reduce coking. Typical nitrogen-containing detergents are those formed by the reaction of a polyisobutylene-substituted succinic acid derivative with a polyalkylene polyamine. However newer engines including finer injector nozzles are more sensitive and current diesel fuels may not be suitable for use with the new engines incorporating these smaller nozzle holes.

In order to maintain performance with engines containing these smaller nozzle holes much higher treat rates of existing additives would need to be used. This is inefficient and costly, and in some cases very high treat rates can also cause fouling.

The present inventor has developed diesel fuel compositions which when used in diesel engines with high pressure fuel systems provide improved performance compared with diesel fuel compositions of the prior art.

According to a first aspect of the present invention there is provided a diesel fuel composition comprising a performance enhancing additive, wherein the performance enhancing additive is the product of a Mannich reaction between:

(a) an aldehyde;

(b) a polyamine; and (c) an optionally substituted phenol;

wherein the or each substituent of the phenol component (c) has an average molecular weight of less than 400.

Preferably molecules of the performance enhancing additive product have an average molecular weight of less than 10000, preferably less than 7500, preferably less than 2000, more preferably less than 1500, preferably less than 1300, for example less than 1200, preferably less than 1100, for example less than 1000.

Preferably the performance enhancing additive product has a molecular weight of less than 900, more preferably less than 850 and most preferably less than 800.

Any aldehyde may be used as aldehyde component (a). Preferably the aldehyde component (a) is an aliphatic aldehyde. Preferably the aldehyde has 1 to 10 carbon atoms, preferably 1 to 6 carbon atoms, more preferably 1 to 3 carbon atoms. Most preferably the aldehyde is formaldehyde.

Polyamine component (b) may be selected from any compound including two or more amine groups. Preferably the polyamine is a polyalkylene polyamine. Preferably the polyamine is a polyalkylene polyamine in which the alkylene component has 1 to 6, preferably 1 to 4, most preferably 2 to 3 carbon atoms. Most preferably the polyamine is a polyethylene polyamine.

Preferably the polyamine has 2 to 15 nitrogen atoms, preferably 2 to 10 nitrogen atoms, more preferably 2 to 8 nitrogen atoms or in some cases 3 to 8 nitrogen atoms.

In especially preferred embodiments, polyamine component (b) includes the moiety $R^1R^2NCHR^3CHR^4NR^5R^6$ wherein each of $R^1$, $R^2$, $R^3$, $R^4$, $R^5$ and $R^6$ is independently selected from hydrogen, and an optionally substituted alkyl, alkenyl, alkynyl, aryl, alkylaryl or arylalkyl substituent.

Thus the polyamine reactants used to make the Mannich reaction products of the present invention preferably include an optionally substituted ethylene diamine residue.

Preferably at least one of $R^1$ and $R^2$ is hydrogen. Preferably both of $R^1$ and $R^2$ are hydrogen.

Preferably at least two of $R^1$, $R^2$, $R^5$ and $R^6$ are hydrogen.

Preferably at least one of $R^3$ and $R^4$ is hydrogen. In some preferred embodiments each of $R^3$ and $R^4$ is hydrogen. In some embodiments $R^3$ is hydrogen and $R^4$ is alkyl, for example $C_1$ to $C_4$ alkyl, especially methyl.

Preferably at least one of $R^5$ and $R^6$ is an optionally substituted alkyl, alkenyl, alkynyl, aryl, alkylaryl or arylalkyl substituent.

In embodiments in which at least one of $R^1$, $R^2$, $R^3$, $R^4$, $R^5$ and $R^6$ is not hydrogen, each is independently selected from an optionally substituted alkyl, alkenyl, alkynyl, aryl, alkylaryl or arylalkyl moiety. Preferably each is independently selected from hydrogen and an optionally substituted C(1-6) alkyl moiety.

In particularly preferred compounds each of $R^1$, $R^2$, $R^3$, $R^4$ and $R^5$ is hydrogen and $R^6$ is an optionally substituted alkyl, alkenyl, alkynyl, aryl, alkylaryl or arylalkyl substituent. Preferably $R^6$ is an optionally substituted C(1-6) alkyl moiety.

Such an alkyl moiety may be substituted with one or more groups selected from hydroxyl, amino (especially unsubstituted amino; —NH—, —$NH_2$), sulpho, sulphoxy, C(1-4) alkoxy, nitro, halo (especially chloro or fluoro) and mercapto.

There may be one or more heteroatoms incorporated into the alkyl chain, for example O, N or S, to provide an ether, amine or thioether.

Especially preferred substituents $R^1$, $R^2$, $R^3$, $R^4$, $R^5$ or $R^6$ are hydroxy-C(1-4)alkyl and amino-(C(1-4)alkyl, especially HO—$CH_2$—$CH_2$— and $H_2N$—$CH_2$—$CH_2$—.

Suitably the polyamine includes only amine functionality, or amine and alcohol functionalities.

The polyamine may, for example, be selected from ethylenediamine, diethylenetriamine, triethylenetetramine, tetraethylenepentamine, pentaethylenehexamine, hexaethyleneheptamine, heptaethyleneoctamine, propane-1,2-diamine, 2(2-amino-ethylamino)ethanol, and $N^1$,$N^1$-bis(2-aminoethyl)ethylenediamine($N(CH_2CH_2NH_2)_3$). Most preferably the polyamine comprises tetraethylenepentamine or especially ethylenediamine.

Commercially available sources of polyamines typically contain mixtures of isomers and/or oligomers, and products prepared from these commercially available mixtures fall within the scope of the present invention.

Optionally substituted phenol component (c) may be substituted with 0 to 4 groups on the aromatic ring (in addition to the phenol OH). For example it may be a tri- or di-substituted phenol. Most preferably component (c) is a mono-substituted phenol. Substitution may be at the ortho, and/or meta, and/or para position(s).

Each phenol moiety may be ortho, meta or para substituted with the aldehyde/amine residue. Compounds in which the aldehyde residue is ortho or para substituted are most commonly formed. Mixtures of compounds may result. In preferred embodiments the starting phenol is para substituted and thus the ortho substituted product results.

The phenol may be substituted with any common group, for example one or more of an alkyl group, an alkenyl group, an alkynyl group, a nitryl group, a carboxylic acid, an ester, an ether, an alkoxy group, a halo group, a further hydroxyl group, a mercapto group, an alkyl mercapto group, an alkyl sulphoxy group, a sulphoxy group, an aryl group, an arylalkyl group, a substituted or unsubstituted amine group or a nitro group.

Preferably the phenol carries one or more optionally substituted alkyl substituents. The alkyl substituent may be optionally substituted with, for example, hydroxyl, halo, (especially chloro and fluoro), alkoxy, alkyl, mercapto, alkyl sulphoxy, aryl or amino residues. Preferably the alkyl group consists essentially of carbon and hydrogen atoms. The substituted phenol may include a alkenyl or alkynyl residue including one or more double and/or triple bonds. Most preferably the component (c) is an alkyl substituted phenol group in which the alkyl chain is saturated. The alkyl chain may be linear or branched. Preferably component (c) is a monoalkyl phenol, especially a para-substituted monoalkyl phenol.

Preferably component (c) comprises an alkyl substituted phenol in which the phenol carries one or more alkyl chains having a total of less 28 carbon atoms, preferably less than 24 carbon atoms, more preferably less than 20 carbon atoms, preferably less than 18 carbon atoms, preferably less than 16 carbon atoms and most preferably less than 14 carbon atoms.

Preferably the or each alkyl substituent of component (c) has from 4 to 20 carbons atoms, preferably 6 to 18, more preferably 8 to 16, especially 10 to 14 carbon atoms. In a particularly preferred embodiment, component (c) is a phenol having a C12 alkyl substituent.

Preferably the or each substituent of phenol component (c) has a molecular weight of less than 350, preferably less than 300, more preferably less than 250 and most preferably less than 200. The or each substituent of phenol component (c) may suitably have a molecular weight of from 100 to 250, for example 150 to 200.

Molecules of component (c) preferably have a molecular weight on average of less than 1800, preferably less than 800, preferably less than 500, more preferably less than 450, preferably less than 400, preferably less than 350, more preferably less than 325, preferably less than 300 and most preferably less than 275.

Components (a), (b) and (c) may each comprise a mixture of compounds and/or a mixture of isomers.

The performance enhancing additive of the present invention is preferably the reaction product obtained by reacting components (a), (b) and (c) in a molar ratio of from 5:1:5 to 0.1:1:0.1, more preferably from 3:1:3 to 0.5:1:0.5.

To form the performance enhancing additive of the present invention components (a) and (b) are preferably reacted in a molar ratio of from 4:1 to 1:1 (aldehyde:polyamine), preferably from 2:1 to 1:1.

To form a preferred performance enhancing additive of the present invention the molar ratio of component (a) to component (c) in the reaction mixture is preferably at least 0.75:1, preferably from 0.75:1 to 4:1, preferably 1:1 to 4:1, more preferably from 1:1 to 2:1. There may be an excess of aldehyde. In preferred embodiments the molar ratio of component (a) to component (c) is approximately 1:1, for example from 0.8:1 to 1.5:1 or from 0.9:1 to 1.25:1.

To form a preferred performance enhancing additive of the present invention the molar ratio of component (c) to component (b) in the reaction mixture used to prepare the performance enhancing additive is preferably at least 1.5:1, more preferably at least 1.6:1, more preferably at least 1.7:1, for example at least 1.8:1, preferably at least 1.9:1. The molar ratio of component (c) to component (b) may be up to 5:1; for example it may be up to 4:1, or up to 3.5:1. Suitably it is up to 3.25:1, up to 3:1, up to 2.5:1, up to 2.3:1 or up to 2.1:1.

Preferred compounds used in the present invention are typically formed by reacting components (a), (b) and (c) in a molar ratio of 2 parts (A) to 1 part (b)±0.2 parts (b), to 2 parts (c)±0.4 parts (c); preferably approximately 2:1:2 (a:b:c). These are commonly known in the art as bis-Mannich reaction products. The present invention thus provides a diesel fuel composition comprising a performance enhancing additive formed by the bis-Mannich reaction product of an aldehyde, a polyamine and an optionally substituted phenol, in which it is believed that a valuable proportion of the molecules of the performance enhancing additive are in the form of a bis-Mannich reaction product.

In other preferred embodiments the performance enhancing additive includes the reaction product of 1 mole of aldehyde with one mole of polyamine and one mole of phenol. The performance enhancing additive may contain a mixture of compounds resulting from the reaction of components (a), (b), (c) in a 2:1:2 molar ratio and a 1:1:1 molar ratio. Alternatively or additionally the performance enhancing additive may include compounds resulting from the reaction of 1 mole of optionally substituted phenol with 2 moles of aldehyde and 2 moles of polyamine.

Reaction products of this invention are believed to be defined by the general formula X

X

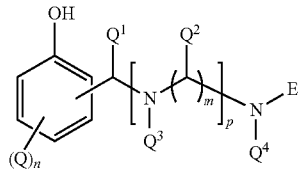

where E represents a hydrogen atom or a group of formula

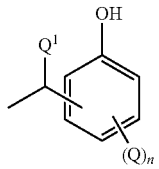

where the/each Q is independently selected from an optionally substituted alkyl group, $Q^1$ is a residue from the aldehyde component, m is from 1 to 6, n is from 0 to 4, p is from 0 to 12, $Q^2$ is selected from hydrogen and an optionally substituted alkyl group, $Q^3$ is selected from hydrogen and an optionally substituted alkyl group, and $Q^4$ is selected from hydrogen and an optionally substituted alkyl group; provided that when p is 0, $Q^4$ is an amino-substituted alkyl group.

n may be 0, 1, 2, 3, or 4. Preferably n is 1 or 2, most preferably 1.

m is preferably 2 or 3 but may be larger and the alkylene group may be straight chained or branched. Most preferably m is 2.

Q is preferably an optionally substituted alkyl group having up to 30 carbons. Q may be substituted with halo, hydroxy, amino, sulphoxy, mercapto, nitro, aryl residues or may include one or more double bonds. Preferably Q is a simple alkyl group consisting essentially of carbon and hydrogen atoms and is predominantly saturated. Q preferably has 5 to 20, more preferably 10 to 15 carbon atoms. Most preferably Q is an alkyl chain of 12 carbon atoms.

$Q^1$ may be any suitable group. It may be selected from an aryl, alkyl, or alkynyl group optionally substituted with halo, hydroxy, nitro, amino, sulphoxy, mercapto, alkyl, aryl or alkenyl. Preferably $Q^1$ is hydrogen or an optionally substituted alkyl group, for example an alkyl group having 1 to 4 carbon atoms. Most preferably $Q^1$ is hydrogen.

Preferably p is from 0 to 7, more preferably from 0 to 6, most preferably from 0 to 4.

The polyamines used to form the Mannich reaction products of the present invention may be straight chained or branched, although the straight chain version is shown in formula X. In reality it is likely that some branching will be present. The skilled person would also appreciate that although in the structure shown in formula X two terminal nitrogen atoms may be bonded to phenol(s) via aldehyde residue(s), it is also possible that internal secondary amine moieties within the polyamine chain could react with the aldehyde and thus a different isomeric product would result.

When a group $Q^2$ is not hydrogen, it may be a straight chained or branched alkyl group. The alkyl group may be optionally substituted. Such an alkyl group may typically include one or more amino and/or hydroxyl substituents.

When $Q^3$ is not hydrogen, it may be a straight chained or branched alkyl group. The alkyl group may be optionally substituted. Such an alkyl group may typically include one or more amino and/or hydroxyl substituents.

When $Q^4$ is not hydrogen, it may be a straight chained or branched alkyl group. The alkyl group may be optionally substituted. Such an alkyl group may typically include one or more amino and/or hydroxyl substituents. As noted above, however, when p is 0, $Q^4$ is an amino-substituted alkyl group. Suitably $Q^4$ comprises the residue of a polyamine, as defined herein as component (b).

The performance enhancing additive of the present invention suitably includes compounds of formula X above, formed by the reaction of two moles of aldehyde with one mole of polyamine and two moles of optionally substituted phenol. Such compounds are believed to conform to the formula definition

XI

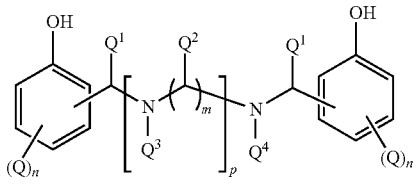

where Q, $Q^1$, $Q^2$, $Q^3$, $Q^4$, m, n and p, are as defined above. Preferably compounds of formula XI formed by the reaction of two moles of aldehyde with one mole of polyamine and two moles of optionally substituted phenol provide at least 40 wt %, preferably at least 50 wt %, preferably at least 60 wt %, preferably at least 70 wt %, and preferably at least 80 wt %, of the performance enhancing additive. There may also be other compounds present, for example the reaction product of 1 mole of aldehyde with one mole of polyamine and one mole of phenol, or the reaction product of 1 mole of phenol with 2 moles of aldehyde and 2 moles of polyamine. Suitably however such other compounds are present in a total amount of less than 60 wt %, preferably less than 50 wt %, preferably less than 50 wt %, preferably less than 40 wt %, preferably less than 30 wt %, preferably less than 20 wt %, of the performance enhancing additive.

One form of preferred bis-Mannich product is where two optionally substituted aldehyde-phenol residues are connected to different nitrogen atoms which are part of a chain between the optionally substituted aldehyde-phenol residues, as shown in Formula XII

XII

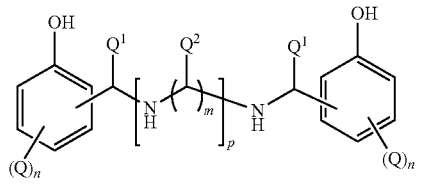

wherein Q, $Q^1$, $Q^2$, m and n are as defined above and p is from 1 to 12, preferably from 1 to 7, preferably from 1 to 6, most preferably from 1 to 4. Thus, compounds of formula I are a sub-set of compounds of formula X in which $Q^3$=$Q^4$=hydrogen, and p is not 0 (zero).

A special class of bis-Mannich reaction products are bridged bis-Mannich products, in which a single nitrogen atom links two optionally substituted aldehyde-phenol residues, for example optionally substituted phenol-$CH_2$— groups. Preferably the nitrogen atom carries the residues of an optionally substituted ethylene diamine group.

In graphical terms preferred resulting compounds are believed to be as shown in Figure XIII

XIII

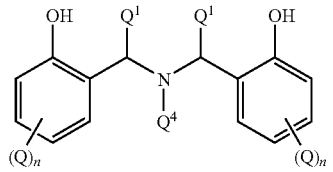

wherein Q, $Q^1$ and n are as defined above and $Q^4$ is preferably the residue of a polyamine, as described herein as component (b); preferably a polyethylene polyamine, most preferably an optionally substituted ethylenediamine moiety, as described above. Thus, compounds of formula II are a sub-set of compounds of formula X, in which p is 0 (zero). The primary nitrogen group which has reacted with aldehydes may or may not be part of the ethylenediamine moiety; preferably, however, it is part of the ethylenediamine moiety.

The present inventor has found that the use of an additive including significant amounts of bridged-Mannich reaction products provides particular benefit. In some preferred embodiments the bridged bis-Mannich reaction products provide at least 20 wt % of the bis-Mannich reaction products, preferably at least 30 wt %, preferably at least 40 wt %, preferably at least 50 wt %, preferably at least 60 wt %, preferably at least 70 wt %, preferably at least 80 wt %, preferably at least 90 wt %.

The formation of the preferred bridged-Mannich compounds to a desired proportion may be promoted in several ways, including by any one or more of: selection of suitable reactants (including favoured amine reactants as defined above); selection of a favoured ratio of reactants, most preferably the molar ratio of approximately 2:1:2 (a:b:c); selection of suitable reaction conditions; and/or by chemical protection of reactive site(s) of the amine leaving one primary nitrogen group free to react with the aldehydes, optionally followed, after reaction is complete, by deprotection. Such measures are within the competence of the skilled person.

In all such cases mixtures of isomers and/or oligomers are within the scope of the present invention.

In some alternative embodiments the molar ratio of polyamine to aldehyde to phenol may be in the region of 1:1:1 and the resulting performance enhancing additive of the present invention may include compounds of formula XIV

XIV

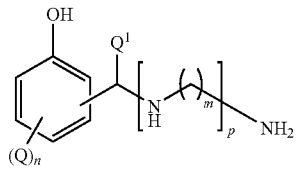

wherein Q, Q', n, m and p are substantially as defined above.

In some embodiments the performance enhancing additive may include compounds of formula XI and/or XII and/or XIII and/or XIV.

In some alternative embodiments the molar ratio of polyamine to phenol may be in the region of 3:1 (for example from 2.5:1 to 3.5:1 or from 2.8:1 to 3.2:1). If the polyamine includes three primary or secondary amine groups, a tris Mannich reaction product could be formed. For example if 1 mole of $N(CH_2CH_2NH_2)_3$ is reacted with 3 moles of formaldehyde and 3 moles of a para-alkyl phenol, a product shown in structure XV could be formed.

XV

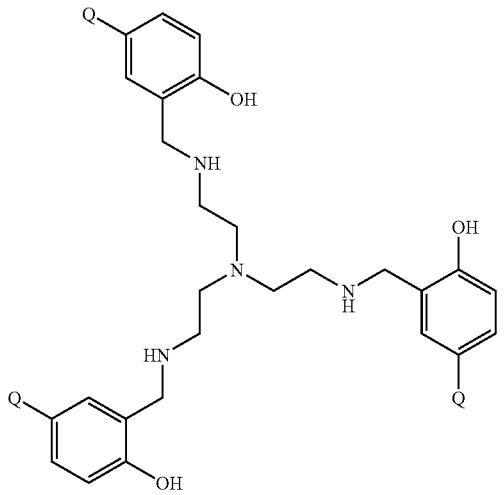

Such compounds have also been found to have advantageous properties.

The skilled person would appreciate that the Mannich reaction products of the performance enhancing additive of the present invention are complex mixtures of products. However the present inventor has noted that using reactants and/or reactant ratios and/or conditions which favour the formation of bis and especially bridged Mannich reaction products (or alternatively tris-reaction products) provides additives which when dosed into fuels show improved performance. However the present invention is not limited to such embodiments.

In some embodiments the performance enhancing additive may include oligomers resulting from the reaction of components (a), (b) and (c). These oligomers may include molecules having the formulae shown in figure III

III

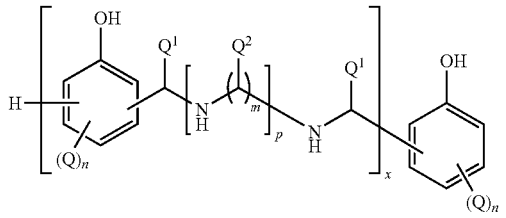

wherein Q, $Q^1$, $Q^2$, n, m and p are as described above and x is from 1 to 12, for example from 1 to 8, more preferably from 1 to 4.

Isomeric structures may also be formed and oligomers in which more than 2 aldehyde residues are connected to a single phenol and/or amine residue may be present.

The performance enhancing additive is preferably present in the diesel fuel composition in an amount of less than 5000 ppm, preferably less than 1000 ppm, preferably less than 500 ppm, more preferably less than 100 ppm, preferably less than 75 ppm, preferably less than 60 ppm, more preferably less than 50 ppm, more preferably less than 40 ppm, for example less than 30 ppm such as 25 ppm or less.

As stated previously, fuels containing biodiesel or metals are known to cause fouling. Severe fuels, for example those containing high levels of metals and/or high levels of biodiesel may require higher treat rates of the performance enhancing additive than fuels which are less severe.

It is envisaged that some fuels may be less severe and thus require lower treat rates of the performance enhancing additive for example less than 25 ppm, such as less than 20 ppm, for example less than 15 ppm, less than 10 ppm or less than 5 ppm.

In some embodiments, the performance enhancing additive may be present in an amount of from 0.1 to 100 ppm, for example 1 to 60 ppm or 5 to 50 ppm or 10 to 40 ppm or 20 to 30 ppm.

Preferably the fuel composition further comprises a nitrogen-containing detergent. The nitrogen-containing detergent may be selected from any suitable nitrogen-containing ashless detergent or dispersant known in the art for use in lubricant or fuel oil. Suitably it is not itself the product of a Mannich reaction between:

(a) an aldehyde;

(b) a polyamine; and (c) an optionally substituted phenol, in which the or each substituent of the phenol component (c) has an average molecular weight of less than 400. Most preferably it is not itself the product of any Mannich reaction between:

(a) an aldehyde;

(b) a polyamine; and (c) an optionally substituted phenol.

Preferred nitrogen-containing detergents are the reaction product of a carboxylic acid-derived acylating agent and an amine.

A number of acylated, nitrogen-containing compounds having a hydrocarbyl substituent of at least 8 carbon atoms and made by reacting a carboxylic acid acylating agent with an amino compound are known to those skilled in the art. In such compositions the acylating agent is linked to the amino compound through an imido, amido, amidine or acyloxy ammonium linkage. The hydrocarbyl substituent of at least carbon atoms may be in either the carboxylic acid acylating agent derived portion of the molecule or in the amino compound derived portion of the molecule, or both. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines typically having aliphatic substituents of up to about 30 carbon atoms, and up to 11 nitrogen atoms.

A preferred class of acylated amino compounds suitable for use in the present invention are those formed by the reaction of an acylating agent having a hydrocarbyl substituent of at least 8 carbon atoms and a compound comprising at least one primary or secondary amine group. The acylating agent may be a mono- or polycarboxylic acid (or reactive equivalent thereof) for example a substituted succinic, phthalic or propionic acid and the amino compound may be a polyamine or a mixture of polyamines, for example a mixture of ethylene polyamines.

Alternatively the amine may be a hydroxyalkyl-substituted polyamine. The hydrocarbyl substituent in such acylating agents preferably comprises at least 10, more preferably at least 12, for example 30 or 50 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred. In a particularly preferred embodiment, the hydrocarbyl substituent has a number average molecular weight of 700-1000, preferably 700-850 for example 750.

Illustrative of hydrocarbyl substituent based groups containing at least eight carbon atoms are n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. The hydrocarbyl substituent may also be derived from the halogenated (e.g. chlorinated or brominated) analogs of such homo- or interpolymers. Alternatively the substituent may be made from other sources, for example monomeric high molecular weight alkenes (e.g. 1-tetra-contene) and chlorinated analogs and hydrochlorinated analogs thereof, aliphatic petroleum fractions, for example paraffin waxes and cracked and chlorinated analogs and hydrochlorinated analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

The term "hydrocarbyl" as used herein denotes a group having a carbon atom directly attached to the remainder of the molecule and having a predominantly aliphatic hydrocarbon character. Suitable hydrocarbyl based groups may contain non-hydrocarbon moieties. For example they may contain up to one non-hydrocarbyl group for every ten carbon atoms provided this non-hydrocarbyl group does not significantly alter the predominantly hydrocarbon character of the group. Those skilled in the art will be aware of such groups, which include for example hydroxyl, halo (especially chloro and fluoro), alkoxyl, alkyl mercapto, alkyl sulphoxy, etc. Preferred hydrocarbyl based substituents are purely aliphatic hydrocarbon in character and do not contain such groups.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

Preferred hydrocarbyl-based substituents are poly-(isobutene)s known in the art.

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Amino compounds useful for reaction with these acylating agents include the following:

(1) polyalkylene polyamines of the general formula:

$$(R^3)_2N[U—N(R^3)]_nR^3$$

wherein each $R^3$ is independently selected from a hydrogen atom, a hydrocarbyl group or a hydroxy-substituted hydrocarbyl group containing up to about 30 carbon atoms, with proviso that at least one $R^3$ is a hydrogen atom, n is a whole number from 1 to 10 and U is a C1-18 alkylene group. Preferably each $R^3$ is independently selected from hydrogen, methyl, ethyl, propyl, isopropyl, butyl and isomers thereof. Most preferably each $R^3$ is ethyl or hydrogen. U is preferably a C1-4 alkylene group, most preferably ethylene.

(2) heterocyclic-substituted polyamines including hydroxyalkyl-substituted polyamines wherein the polyamines are as described above and the heterocyclic substituent is selected from nitrogen-containing aliphatic and aromatic heterocycles, for example piperazines, imidazolines, pyrimidines, morpholines, etc.

(3) aromatic polyamines of the general formula:

$$Ar(NR^3{}_2)_y$$

wherein Ar is an aromatic nucleus of 6 to 20 carbon atoms, each $R^3$ is as defined above and y is from 2 to 8.

Specific examples of polyalkylene polyamines (1) include ethylenediamine, diethylenetriamine, triethylenetetramine, tetraethylenepentamine, tri(tri-methylene)tetramine, pentaethylenehexamine, hexaethylene-heptamine, 1,2-propylenediamine, and other commercially available materials which comprise complex mixtures of polyamines. For example, higher ethylene polyamines optionally containing all or some of the above in addition to higher boiling fractions containing 8 or more nitrogen atoms etc. Specific examples of hydroxyalkyl-substituted polyamines include N-(2-hydroxyethyl) ethylene diamine, N,N'-bis(2-hydroxyethyl)ethylene diamine, N-(3-hydroxybutyl)tetramethylene diamine, etc. Specific examples of the heterocyclic-substituted polyamines (2) are N-2-aminoethyl piperazine, N-2 and N-3 amino propyl morpholine, N-3(dimethyl amino)propyl piperazine, 2-heptyl-3-(2-aminopropyl)imidazoline, 1,4-bis(2-aminoethyl)piperazine, 1-(2-hydroxy ethyl)piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763, 4,234,435 and U.S. Pat. No. 6,821,307.

A typical acylated nitrogen-containing compound of this class is that made by reacting a poly(isobutene)-substituted succinic acid-derived acylating agent (e.g., anhydride, acid, ester, etc.) wherein the poly(isobutene) substituent has between about 12 to about 200 carbon atoms with a mixture of ethylene polyamines having 3 to about 9 amino nitrogen atoms per ethylene polyamine and about 1 to about 8 ethylene groups. These acylated nitrogen compounds are formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. This type of acylated amino compound and the preparation thereof is well known to those skilled in the art and are described in the above-referenced US patents.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the monocarboxylic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715.

A further type of acylated nitrogen compound suitable for use in the present invention is the product of the reaction of a fatty monocarboxylic acid of about 12-30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12-30 carbon atoms. Fatty dicarboxylic acids could also be used. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch may not be alkyl in nature, for example phenyl and cyclohexyl stearic acid and the chloro-stearic acids. Branched chain fatty carboxylic acid/alkylene polyamine products have been described extensively in the art. See for example, U.S. Pat. Nos. 3,110,673; 3,251,853; 3,326,801; 3,337,459; 3,405,064; 3,429,674; 3,468,639;

3,857,791. These patents are referenced for their disclosure of fatty acid/polyamine condensates for their use in lubricating oil formulations.

The nitrogen-containing detergent is preferably present in the composition of the first aspect an amount up to 1000 ppm, preferably up to 500 ppm, preferably up to 300 ppm, more preferably up to 200 ppm, preferably up to 100 ppm and most preferably up to 70 ppm. The nitrogen-containing detergent is preferably present in an amount of at least 1 ppm, preferably at least 10 ppm, more preferably at least 20 ppm, preferably at least 30 ppm.

All values of ppm given herein refer to parts per million by weight of the total composition.

Preferably the weight ratio of nitrogen-containing detergent to performance enhancing additive is at least 0.5:1, preferably at least 1:1, more preferably at least 2:1. The weight ratio of nitrogen-containing detergent to performance enhancing additive may be up to 100:1, preferably up to 30:1, suitably up to 10:1, for example up to 5:1.

In some preferred embodiments the diesel fuel composition of the present invention further comprises a metal deactivating compound. Any metal deactivating compound known to those skilled in the art may be used and include, for example, the substituted triazole compounds of figure IV wherein R and R' are independently selected from an optionally substituted alkyl group or hydrogen.

IV

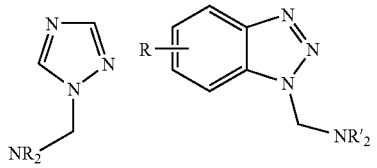

Preferred metal deactivating compounds are those of formula V:

V

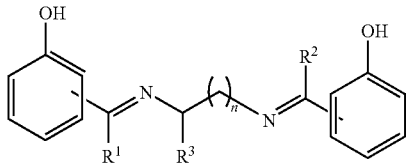

wherein $R^1$, $R^2$ and $R^3$ are independently selected from an optionally-substituted alkyl group or hydrogen, preferably an alkyl group from 1 to 4 carbon atoms or hydrogen. $R^1$ is preferably hydrogen, $R^2$ is preferably hydrogen and $R^3$ is preferably methyl. n is an integer from 0 to 5, most preferably 1.

A particularly preferred metal deactivator is N,N'-disalicyclidene-1,2-diaminopropane, and has the formula shown in figure VI.

VI

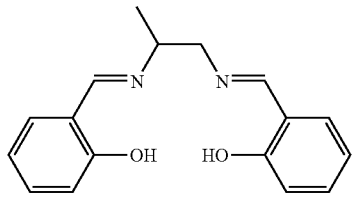

Another preferred metal deactivating compound is shown in figure VII:

VII

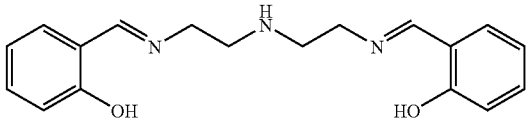

The metal deactivating compound is preferably present in an amount of less than 100 ppm, and more preferably less than 50 ppm, preferably less than 30 ppm, more preferably less than 20, preferably less than 15, preferably less than 10 and more preferably less than 5 ppm. The metal deactivator is preferably present as an amount of from 0.0001 to 50 ppm, preferably 0.001 to 20, more preferably 0.01 to 10 ppm and most preferably 0.1 to 5 ppm.

The weight ratio of the performance enhancing additive to the metal deactivator is preferably from 100:1 to 1:100, more preferably from 50:1 to 1:50, preferably from 25:1 to 1;25, more preferably from 10:1 to 1:10, preferably from 5:1 to 1:5, preferably from 3:1 to 1:3, more preferably from 2:1 to 1:2 and most preferably from 1.5:1 to 1:1.5.

The diesel fuel composition of the present invention may include one or more further additives such as those which are commonly found in diesel fuels. These include, for example, antioxidants, dispersants, detergents, wax anti-settling agents, cold flow improvers, cetane improvers, dehazers, stabilisers, demulsifiers, antifoams, corrosion inhibitors, lubricity improvers, dyes, markers, combustion improvers, odour masks, drag reducers and conductivity improvers.

In particular, the composition of the present invention may further comprise one or more additives known to improve the performance of diesel engines having high pressure fuel systems. Such additives are known to those skilled in the art and include, for example, the compounds described in EP 1900795, EP 1887074 and EP 1884556.

Suitably the diesel fuel composition may include an additive comprising a salt formed by the reaction of a carboxylic acid with a di-n-butylamine or tri-n-butylamine. Suitably the fatty acid is of the formula $[R'(COOH)_x]_y$, where each R' is a independently a hydrocarbon group of between 2 and 45 carbon atoms, and x is an integer between 1 and 4.

Preferably R' is a hydrocarbon group of 8 to 24 carbon atoms, more preferably 12 to 20 carbon atoms. Preferably, x is 1 or 2, more preferably x is 1. Preferably, y is 1, in which case the acid has a single R' group. Alternatively, the acid may be a dimer, trimer or higher oligomer acid, in which case y will be greater than 1 for example 2, 3 or 4 or more. R' is suitably an alkyl or alkenyl group which may be linear or branched. Examples of carboxylic acids which may be used in the present invention include lauric acid, myristic acid, palmitic acid, stearic acid, isostearic acid, neodecanoic acid, arachic acid, behenic acid, lignoceric acid, cerotic acid, montanic acid, melissic acid, caproleic acid, oleic acid, elaidic acid, linoleic acid, linolenic acid, coconut oil fatty acid, soy bean fatty acid, tall oil fatty acid, sunflower oil fatty acid, fish oil fatty acid, rapeseed oil fatty acid, tallow oil fatty acid and palm oil fatty acid. Mixtures of two or more acids in any proportion are also suitable. Also suitable are the anhydrides of carboxylic acids, their derivatives and mixtures thereof. In a preferred embodiment, the carboxylic acid comprises tall oil fatty acid (TOFA). It has been found that TOFA with a saturate content of less than 5% by weight is especially suitable.

When such additives are present in diesel fuel as the only means of reducing injector deposits they are typically added at treat rates of 20-400 ppm eg 20-200 ppm.

The treat rate of such additives would typically be less than the upper limit of these ranges eg less than 400 ppm or less than 200 ppm and possibly lower than the lower limit of this range eg less than 20 ppm, for example down to 5 ppm or 2 ppm, when used in combination with the performance enhancing additives of the present invention.

Suitably the diesel fuel composition may include an additive comprising the reaction product between a hydrocarbyl-substituted succinic acid or anhydride and hydrazine.

Preferably, the hydrocarbyl group of the hydrocarbyl-substituted succinic acid or anhydride comprises a $C_8$-$C_{36}$ group, preferably a $C_8$-$C_{18}$ group. Non-limiting examples include dodecyl, hexadecyl and octadecyl. Alternatively, the hydrocarbyl group may be a polyisobutylene group with a number average molecular weight of between 200 and 2500, preferably between 800 and 1200. Mixtures of species with different length hydrocarbyl groups are also suitable, e.g. a mixture of $C_{16}$-$C_{18}$ groups.

The hydrocarbyl group is attached to a succinic acid or anhydride moiety using methods known in the art. Additionally, or alternatively, suitable hydrocarbyl-substituted succinic acids or anhydrides are commercially available e.g. dodecylsuccinic anhydride (DDSA), hexadecylsuccinic anhydride (HDSA), octadecylsuccinic anhydride (ODSA) and polyisobutylsuccinic anhydride (PIBSA).

Hydrazine has the formula:

$$NH_2—NH_2$$

Hydrazine may be hydrated or non-hydrated. Hydrazine monohydrate is preferred.

The reaction between the hydrocarbyl-substituted succinic acid or anhydride and hydrazine produces a variety of products, such as is disclosed in EP 1887074. It is believed to be preferable for good detergency that the reaction product contains a significant proportion of species with relatively high molecular weight. It is believed—without the matter having been definitively determined yet, to the best of our knowledge—that a major high molecular weight product of the reaction is an oligomeric species predominantly of the structure:

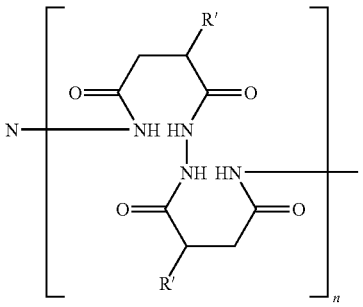

where n is an integer and greater than 1, preferably between 2 and 10, more preferably between 2 and 7, for example 3, 4 or 5. Each end of the oligomer may be capped by one or more of a variety of groups. Some possible examples of these terminal groups include:

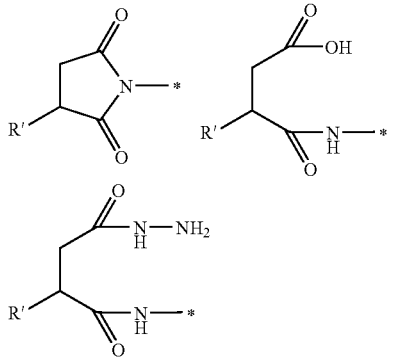

Alternatively, the oligomeric species may form a ring having no terminal groups:

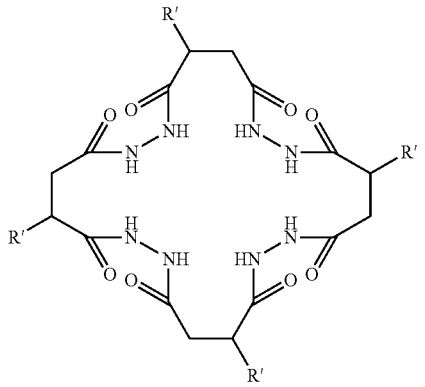

When such additives are present in diesel fuel as the only means of reducing injector deposits they are typically added at treat rates of 10-500 ppm eg 20-100 ppm.

The treat rate of such additives would typically be less than the upper limit of these ranges eg less than 500 ppm or less than 100 ppm and possibly lower than the lower limit of this range eg less than 20 ppm or less than 10 ppm, for example down to 5 ppm or 2 ppm, when used in combination with the performance enhancing additives of this invention.

Suitably the diesel fuel composition may include an additive comprising at least one compound of formula (I) and/or formula (II):

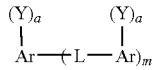

(I)

wherein each Ar independently represents an aromatic moiety having 0 to 3 substituents selected from the group consisting of alkyl, alkoxy, alkoxyalkyl, aryloxy, aryloxyalkyl, hydroxy, hydroxyalkyl, halo and combinations thereof;

each L is independently a linking moiety comprising a carbon-carbon single bond or a linking group;

each Y is independently —$OR^{1''}$ or a moiety of the formula $H(O(CR^1{}_2)_n)_zX$—, wherein X is selected from the group consisting of $(CR^1{}_2)_2$, O and S: $R^1$ and $R^{1'}$ are each independently selected from H, $C_1$ to $C_6$ alkyl and aryl; $R^{1''}$ is selected from $C_1$ to $C_{100}$ alkyl and aryl; z is 1 to 10; n is 0 to 10 when X is $(CR^1{}_2)_2$, and 2 to 10 when X is O or S; and y is 1 to 30;

each a is independently 0 to 3, with the proviso that at least one Ar moiety bears at least one group Y; and m is 1 to 100;

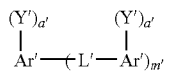

(II)

wherein:

each Ar' independently represents an aromatic moiety having 0 to 3 substituents selected from the group consisting of alkyl, alkoxy, alkoxyalkyl, hydroxy, hydroxyalkyl, acyloxy, acyloxyalkyl, acyloxyalkoxy, aryloxy, aryloxyalkyl, aryloxyalkoxy, halo and combinations thereof;

each L' is independently a linking moiety comprising a carbon-carbon single bond or linking group;

each Y' is independently a moiety of the formula ZO— or $Z(O(CR^2{}_2)_{n'})_{y'}X'$—, wherein X' is selected from the group consisting of $(CR^{2'}{}_2)_{z'}$, O and S; $R^2$ and $R^{2'}$ are each independently selected from H, $C_1$ to $C_6$ alkyl and aryl z' is 1 to 10; n' is 0 to 10 when X' is $(CR^{2'}{}_2)_{z'}$, and 2 to 10 when X' is O or S; y is 1 to 30; Z is H, an acyl group, a polyacyl group, a lactone ester group, an acid ester group, an alkyl group or an aryl group;

each a' is independently 0 to 3, with the proviso that at least one Ar' moiety bears at least one group Y' in which Z is not H; and m' is 1 to 100.

When such additives are present in diesel fuel as the only means of reducing injector deposits they are typically added at treat rates of 50-300 ppm.

The treat rate of such additives would typically be less than the upper limit of these ranges eg less than 300 ppm and possibly lower than the lower limit of this range eg less than 50 ppm, for example down to 20 ppm or 10 ppm, when used in combination with the performance enhancing additives of this invention.

Suitably the diesel fuel composition may include an additive comprising a quaternary ammonium salt which comprises the reaction product of (a) a hydrocarbyl-substituted acylating agent and a compound having an oxygen or nitrogen atom capable of condensing with said acylating agent and further having a tertiary amino group; and (b) a quaternizing agent suitable for converting the tertiary amino group to a quaternary nitrogen wherein the quaternizing agent is selected from the group consisting of dialkyl sulphates, benzyl halides, hydrocarbyl substituted carbonates; hydrocarbyl epoxides in combination with an acid or mixtures thereof.

Examples of quaternary ammonium salt and methods for preparing the same are described in the following patents, which are hereby incorporated by reference, U.S. Pat. No. 4,253,980, U.S. Pat. No. 3,778,371, U.S. Pat. No. 4,171,959, U.S. Pat. No. 4,326,973, U.S. Pat. No. 4,338,206, and U.S. Pat. No. 5,254,138.

Suitable acylating agents and hydrocarbyl substituents are as previously defined in this specification.

Examples of the nitrogen or oxygen containing compounds capable of condensing with the acylating agent and further having a tertiary amino group can include but are not limited to: N,N-dimethyl-aminopropylamine, N,N-diethyl-aminopropylamine, N,N-dimethyl-amino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl)piperidine, 3,3-diamino-N-methyldipropylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N,N-diethylaminopropanol, N,N-diethylaminobutanol, N,N,N-tris(hydroxyethyl)amine and N,N,N-tris(hydroxymethyl)amine.

The composition of the present invention may contain a quaternizing agent suitable for converting the tertiary amino group to a quaternary nitrogen wherein the quaternizing agent is selected from the group consisting of dialkyl sulphates, alkyl halides, benzyl halides, hydrocarbyl substituted carbonates; and hydrocarbyl epoxides in combination with an acid or mixtures thereof.

The quaternizing agent can include halides, such as chloride, iodide or bromide; hydroxides; sulphonates; bisulphites, alkyl sulphates, such as dimethyl sulphate; sulphones; phosphates; C1-12 alkylphosphates; di C1-12 alkylphosphates; borates; C1-12 alkylborates; nitrites; nitrates; carbonates; bicarbonates; alkanoates; O,O-di C1-12 alkyldithiophosphates; or mixtures thereof.

In one embodiment the quaternizing agent may be derived from dialkyl sulphates such as dimethyl sulphate, N-oxides, sulphones such as propane and butane sulphone; alkyl, acyl or aralkyl halides such as methyl and ethyl chloride, bromide or iodide or benzyl chloride, and a hydrocarbyl (or alkyl) substituted carbonates. If the acyl halide is benzyl chloride, the aromatic ring is optionally further substituted with alkyl or alkenyl groups. The hydrocarbyl (or alkyl) groups of the hydrocarbyl substituted carbonates may contain 1 to 50, 1 to 20, 1 to 10 or 1 to 5 carbon atoms per group. In one embodiment the hydrocarbyl substituted carbonates contain two hydrocarbyl groups that may be the same or different. Examples of suitable hydrocarbyl substituted carbonates include dimethyl or diethyl carbonate.

In another embodiment the quaternizing agent can be a hydrocarbyl epoxide, as represented by the following formula, in combination with an acid:

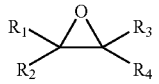

wherein R1, R2, R3 and R4 can be independently H or a C1-50 hydrocarbyl group.

Examples of hydrocarbyl epoxides can include styrene oxide, ethylene oxide, propylene oxide, butylene oxide, stilbene oxide and C2-50 epoxide.

When such quaternary ammonium salt additives are present in diesel fuel as the only means of reducing injector deposits they are typically added at treat rates of 5-500 ppm eg 10-100 ppm.

The treat rate of such additives would typically be less than the upper limit of these ranges eg less than 500 ppm or less than 100 ppm and possibly lower than the lower limit of this range eg less than 10 ppm or less than 5 ppm, for example down to 5 ppm or 2 ppm, when used in combination with the performance enhancing additives of this invention.

The diesel fuel composition of the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition of the present invention may comprise non-renewable Fischer-Tropsch fuels such as those described as GTL (gas-to-liquid) fuels, CTL (coal-to-liquid) fuels and OTL (oil sands-to-liquid).

The diesel fuel composition of the present invention may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, safflower oil, palm 25 oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, in the presence of a catalyst.

The diesel fuel composition may comprise second generation biodiesel. Second generation biodiesel is derived from renewable resources such as vegetable oils and animal fats and processed, often in the refinery, often using hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition of the present invention may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some embodiments the diesel fuel composition of the present invention may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition may comprise a secondary fuel, for example ethanol. Preferably however the diesel fuel composition does not contain ethanol.

Preferably, the diesel fuel has a sulphur content of at most 0.05% by weight, more preferably of at most 0.035% by weight, especially of at most 0.015%. Fuels with even lower levels of sulphur are also suitable such as fuels with less than 50 ppm sulphur by weight, preferably less than 20 ppm, for example 10 ppm or less.

Commonly when present, metal-containing species will be present as a contaminant, for example through the corrosion of metal and metal oxide surfaces by acidic species present in the fuel or from lubricating oil. In use, fuels such as diesel fuels routinely come into contact with metal surfaces for example, in vehicle fueling systems, fuel tanks, fuel transportation means etc. Typically, metal-containing contamination will comprise transition metals such as zinc, iron and copper and others such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. Such catalysts are often based on metals such as iron, cerium, Group I and Group II metals e.g., calcium and strontium, either as mixtures or alone. Also used are platinum and manganese. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the metal-containing species comprises a fuel-borne catalyst.

In some embodiments, the metal-containing species comprises zinc.

Typically, the amount of metal-containing species in the diesel fuel, expressed in terms of the total weight of metal in the species, is between 0.1 and 50 ppm by weight, for example between 0.1 and 10 ppm by weight, based on the weight of the diesel fuel.

The fuel compositions of the present invention show improved performance when used in diesel engines subjected to high pressures and temperatures compared with diesel fuels of the prior art.

According to a second aspect of the present invention there is provided the use of an additive in a diesel fuel composition to improve the engine performance of a diesel engine having a high pressure fuel system using said diesel fuel composition, wherein the additive is the product of a Mannich reaction between:

(a) an aldehyde;

(b) a polyamine; and (c) an optionally substituted phenol;

the or each substituent of component (c) has an average molecular weight of less than 400.

Thus the additive may be regarded as a performance enhancing additive. In a third aspect the invention provides an additive package comprising an additive which is the product of a Mannich reaction as herein defined with reference to the first and second aspects.

The additive package may comprise a mixture of neat performance enhancing additive and optionally neat nitrogen-containing detergent and optionally further additives, for example those described above. Alternatively the additive package may comprise a solution of additives, for example in a mixture of hydrocarbon and/or aromatic solvents.

Preferred aspects of the second and third aspects are as defined in relation to the first aspect.

In preferred embodiments the second aspect comprises the use of a performance enhancing additive as defined in relation to the first aspect to improve the performance of a diesel engine having a high pressure fuel system.

The improvement in performance of the diesel engine having a high pressure fuel system may be measured by a number of ways.

One of the ways in which the improvement in performance can be measured is by measuring the power loss in a controlled engine test, for example as described in relation to example 4.

Use of the performance enhancing additives of the present invention in this test provides a fuel giving a power loss of less than 10%, preferably less than 5%, preferably less than 4% for example less than 3%, less than 2% or less than 1%.

Preferably the use of a fuel composition of the first aspect in a diesel engine having a high pressure fuel system reduces the power loss of that engine by at least 2%, preferably at least 10%, preferably at least 25%, more preferably at least 50% and most preferably at least 80% compared to the base fuel.

The improvement in performance of the diesel engine having a high pressure fuel system may be measured by an improvement in fuel economy.

Improvement in performance may also be assessed by considering the extent to which the use of the performance enhancing additive preferably reduces the amount of deposit on the injector of an engine having a high pressure fuel system.

Direct measurement of deposit build up is not usually undertaken, but is usually inferred from the power loss mentioned earlier or fuel flow rates through the injector. An alternative measure of deposits can be obtained by removing the injectors from the engine and placing in a test rig. A suitable test rig is the DIT 31. The DIT31 has three methods of testing a fouled injector: by measuring the back pressure, the pressure drop or the injector time.

To measure the back pressure, the injector is pressurised to 1000 bar ($10^8$ Pa). The pressure is allowed to fall and the time taken for the pressure to drop between 2 set points is measured. This tests the integrity of the injector which should maintain the pressure for a set period. If there is any failure in performance, the pressure will fall more rapidly. This is a good indication of internal fouling, particularly by gums. For example, a typical passenger car injector may take a minimum of 10 seconds for the pressure to drop between the two set points.

To measure the pressure drop, the injector is pressurised to 1000 bar ($10^8$ Pa). The pressure is allowed to fall and at a set point (750 bar—$7.5\times10^7$ Pa) fires. The drop in pressure during the firing period is measured and is compared to a standard. For a typical passenger car injector this may be 80 bar ($8\times10^6$ Pa). Any blockage in the injector will cause a lower pressure drop than the standard.

During the pressure drop measurement the time that the injector opens for is measured. For typical passenger car injectors this may be 10 ms±1 ms. Any deposit may impinge this opening time causing the pressure drop to be affected. Thus a fouled injector may have a shortened opening time as well as a lower pressure drop.

The present invention is particularly useful in the reduction of deposits on injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

The use of the second aspect may improve the performance of the engine by reducing the deposits on an injector having an aperture with a diameter of less than 500 μm, preferably less than 200 μm, more preferably less than 150 μm. In some embodiments the use may improve the performance of the engine by reducing deposits on an injector with an aperture having a diameter less than 100 μm, preferably less than 80 μm. The use may improve the performance of an engine in which the injector has more than one aperture, for example more than 4 apertures, for example 6 or more apertures.

Within the injector body, clearances of only 1-2 μm exist between moving parts and there have been reports of engine problems in the field caused by injectors sticking and particularly injectors sticking open. Control of deposits in this area can be very important.

The use of the second aspect may improve the performance of the engine by reducing deposits including gums and lacquers within the injector body.

The use of the second aspect may also improve the performance of the engine by reducing deposits in the vehicle fuel filter.

A reduction of deposits in a vehicle fuel filter may be measured quantitatively or qualitatively. In some cases this may only be determined by inspection of the filter once the filter has been removed. In other cases, the level of deposits may be estimated during use.

Many vehicles are fitted with a fuel filter which may be visually inspected during use to determine the level of solids build up and the need for filter replacement. For example, one such system uses a filter canister within a transparent housing allowing the filter, the fuel level within the filter and the degree of filter blocking to be observed.

It has been surprisingly been found that when using the fuel compositions of the present invention the level of deposits in the fuel filter are considerably reduced compared with fuel compositions which do not contain the performance enhancing additive of the invention. This allows the filter to be changed much less frequently and can ensure that fuel filters do not fail between service intervals. Thus the use of the present invention may lead to reduced maintenance costs.

Suitably the use of the performance enhancing additive of the present invention allows the interval between filter replacement to be extended, suitably by at least 5%, preferably at least 10%, more preferably at least 20%, for example at least 30% or at least 50%.

In Europe the Co-ordinating European Council for the development of performance tests for transportation fuels, lubricants and other fluids (the industry body known as CEC), has developed a new test, named CEC F-98-08, to assess whether diesel fuel is suitable for use in engines meeting new European Union emissions regulations known as the "Euro 5" regulations. The test is based on a Peugeot DW10 engine using Euro 5 injectors, and will hereinafter be referred to as the DW10 test. It will be further described in the context of the examples.

Preferably the use of the performance enhancing additives of the present invention leads to reduced deposits in the DW10 test.

Before the priority date of this application, the inventor used the basic procedure for the DW10 test as available at that time and found that the use of the performance enhancing additives of the invention in a diesel fuel composition resulted in a reduction in power loss compared with the same fuel not containing the performance enhancing additive. Details of the test method are given in Example 4.

In addition to the prevention or reduction of the occurrence of injector fouling as described above, the present inventor has also found that compositions of the present invention may be used to remove some or all of the deposits which have already formed on injectors. This is a further way by which an improvement in performance may be measured.

Thus, the present invention further provides the use of a diesel fuel composition of the first aspect to remove deposits formed in a high pressure diesel engine.

Deposits on injectors of an engine having a high pressure fuel system may also be measured using a hot liquid process simulator (or HLPS). This equipment allows the fouling of a metallic component, typically a steel or aluminum rod to be measured.

The HLPS equipment, which is generally known to those skilled in the art, includes a fuel reservoir from which fuel is pumped under pressure and passed over a heated stainless steel tube. The level of deposit on the tube after a certain period can then be measured. This is considered a good way of predicting how a much fuel would deposit on an injector. The equipment was modified to allow fuel to recirculate.

Thus the present invention provides the use of a performance enhancing additive as defined in relation to the first aspect to reduce the deposits from a diesel fuel. This may be measured with a hot liquid process simulator for example using the method as defined in Example 3.

Although the diesel fuel compositions of the present invention provide improved performance of engines operating at high temperature and pressures, they may also be used with traditional diesel engines. This is important because a single fuel must be provide that can be used in new engines and older vehicles.

Any feature of any aspect of the invention may be combined with any other feature, where appropriate.

The invention will now be further defined with reference to the following non-limiting examples. In these examples the terms "inv" denotes examples in accordance with the invention, "ref" denotes an example showing the properties of a base fuel and "comp" denotes comparative examples, not of the invention. However it should be noted that this is for assistance of the reader only and that the final test is whether examples fall within the scope of any actual or potential claims herein. In the examples which follow the values given in parts per million (ppm) for treat rates denote active agent amount, not the amount of a formulation as added, and containing an active agent.

EXAMPLE 1

Additive C was prepared by mixing 0.0287 mol eq. (equivalents) 4-dodecylphenol, 0.0286 mol eq. paraformaldehyde, 0.0143 mol eq. tetraethylenepentamine and 0.1085 mol eq. toluene. The mixture was heated to 110° C. and refluxed for 6 hours. The solvent and water of reaction were then removed under vacuum. In this example the molar ratio of aldehyde (a):polyamine (b):phenol (c) was 2:1:2.

EXAMPLE 2

Additive D was prepared by mixing 0.0311 mol eq. 4-dodecylphenol, 0.0309 mol eq. paraformaldehyde, 0.0306 mol eq. tetraethylenepentamine and 0.1085 mol eq. toluene. The reaction was heated to 110° C. and refluxed for 6 hours. The solvent and water of reaction were then removed under vacuum. In this example the molar ratio of aldehyde (a): polyamine (b):phenol (c) was 1:1:1.

EXAMPLE 3

Diesel fuel compositions were prepared comprising the additives listed in Table 1 below, added to aliquots all drawn from a common batch of RF06 base fuel containing 1 ppm zinc (as zinc neodecanoate).

Table 2 below shows the specification for RF06 base fuel.

Each of the fuel compositions prepared was tested using the Hot Liquid Process Simulator (HLPS) equipment. In this test 800 ml of fuel is pressurised to 500 psi ($3.44\times10^6$ Pa) and flowed over a steel tube heated to 270° C. The test duration is 5 hours. The test method has been modified, by removal of the piston within the fuel reservoir, to allow the degraded fuel to return to the reservoir and mix with the fresh fuel. At the end of test the steel tube is removed and the level of deposit measured as surface carbon.

Also used in the tests of Example 3 were Additive A and Additive B (both comparative). Additive A is a 60% active ingredient solution (in aromatic solvent) of a polyisobutenyl succinimide obtained from the condensation reaction of a polyisobutenyl succinic anhydride derived from polyisobutene of Mn approximately 750 with a polyethylene polyamine mixture of average composition approximating to tetraethylene pentamine. Additive B is N,N'-disalicyclidene-1,2-diaminopropane.

The results are also shown in Table 1.

TABLE 1

| Fuel Composition | A (ppm active) | B (ppm active) | C (ppm active) | D (ppm active) | Surface carbon ($\mu g/cm^2$) |
|---|---|---|---|---|---|
| 1 (ref) | | | | | 117 |
| 2 (comp) | 48 | | | | 124 |
| 3 (comp) | 96 | | | | 101 |
| 4 (comp) | 144 | | | | 49 |
| 5 (comp) | 192 | | | | 29 |
| 6 (comp) | 48 | 2 | | | 20 |
| 7 (inv) | 48 | | 2 | | 30 |
| 8 (inv) | 48 | | 20 | | 16 |
| 9 (inv) | 48 | 2 | 2 | | 5 |
| 10 (inv) | 48 | 2 | | 2 | 4 |
| 11 (inv) | | 2 | 2 | | 9 |

It can be clearly seen from Table 1 that in order to achieve a reduction in deposits using only a conventional nitrogen-containing detergent (Additive A) very high treat rates are needed. A significant improvement in performance is seen when additives of the present invention are also used. These additives are effective at very low concentrations when used with amounts of a traditional nitrogen-containing detergent Additive A that are currently used in diesel fuels (i.e. 48 ppm).

TABLE 2

| Property | Units | Limits Min | Limits Max | Method |
|---|---|---|---|---|
| Cetane Number | | 52.0 | 54.0 | EN ISO 5165 |
| Density at 15° C. | $kg/m^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | $mm^2/sec$ | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1, 4) | µm | — | 400 | CEC F-06-A-96 |
| Fatty Acid Methyl Ester | | prohibited | | |

EXAMPLE 4

Diesel fuel compositions were prepared comprising the additives listed in Table 3, added to aliquots all drawn from a common batch of RF06 base fuel, and containing 1 ppm zinc (as zinc neodecanoate) and tested according to the CEC DW 10 method.

The engine of the injector fouling test is the PSA DW10BTED4. In summary, the engine characteristics are:

Design: Four cylinders in line, overhead camshaft, turbocharged with EGR

Capacity: 1998 $cm^3$

Combustion chamber: Four valves, bowl in piston, wall guided direct injection

Power: 100 kW at 4000 rpm

Torque: 320 Nm at 2000 rpm

Injection system: Common rail with piezo electronically controlled 6-hole injectors.

Max. pressure: 1600 bar ($1.6\times10^8$ Pa). Proprietary design by SIEMENS VDO

Emissions control: Conforms with Euro IV limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions.

The test is run with a future injector design representative of anticipated Euro V injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |

-continued

| Step | Duration (minutes) | Engine Speed (rpm) | Load (%) | Torque (Nm) | Boost Air After IC (° C.) |
|---|---|---|---|---|---|
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds 4. 8 hrs soak period

The standard CEC F-98-08 test method consists of 32 hours engine operation corresponding to 4 repeats of steps 1-3 above, and 3 repeats of step 4. ie 56 hours total test time excluding warm ups and cool downs.

The results are also reported in Table 3, below.

Where we have reported results after 24 hours engine operation; this corresponds to 3 repeats of steps 1-3 above, and 2 repeats of step 4.

Where we have reported results after 48 hours engine operation, this corresponds to a modification to the standard procedure involving 6 repeats of steps 1-3 above, and 5 repeats of step 4.

TABLE 3

| Fuel Comp'n | Additive A (ppm active) | Additive B (ppm active) | Additive C (ppm active) | Power Loss % following engine operation of X hours X = 24 | X = 32 | X = 48 |
|---|---|---|---|---|---|---|
| 12 (ref) | — | — | — | 9 | 10.9 | 13 |
| 13 (comp) | 288 | — | — | 2 | 3.1 | 8 |
| 14 (comp) | 96 | — | — | | 6.6 | |
| 15 (inv) | 192 | 5 | 25 | 3 | 3.0 | 2.5 |
| 16 (inv) | 96 | — | 25 | | 3.0 | |
| 17 (inv) | 48 | — | 25 | 3 | 3.4 | 3.5 |

EXAMPLE 5

Diesel fuel compositions were prepared comprising the additives listed in Table 4 below, added to aliquots all drawn from a common batch of RF06 base fuel containing 10% of bio diesel in the form of Rapeseed Oil Methyl Ester and tested according to the CEC DW10 method. Power loss was recorded after periods of 24 hours, 32 hours and 48 hours of engine operating time corresponding respectively to 3, 4 and 6 operating cycles.

TABLE 4

| Fuel Composition | A (ppm) | C (ppm) | Power Loss % following engine operation of X hours X = 24 | X = 32 | X = 48 |
|---|---|---|---|---|---|
| 18 (ref) | — | — | 7.5 | 10.2 | 13 |
| 19 (comp) | 192 | — | 15 | — | — |
| 20 (comp) | 384 | — | 4.5 | — | — |
| 21 (comp) | 576 | — | 0 | — | — |
| 22 (inv) | 384 | 100 | 0.1 | 0.5 | 1 |
| 23 (inv) | 192 | 100 | −1 | — | — |
| 24 (inv) | 96 | 100 | 2.1 | 2 | 2.5 |
| 25 (inv) | 96 | 50 | 1.9 | 2.5 | 4 |

EXAMPLE 6

Further compounds were prepared using analogous methods to that described in Example 1.

In each case, a Mannich reaction was carried out by reacting formaldehyde and para-dodecyl phenol with the amines listed in Table 1 in the molar ratio stated. The compounds were added to aliquots all drawn from a common batch of RF06 base fuel at the treat rates indicated. The resultant fuel compositions were then subjected to the HLPS test of Example 3 and the surface carbon measured. The results show that the performance enhancing additives of the present invention provide a greater reduction of surface carbon than Mannich products of phenols of higher molecular weight.

$PIB_{780}$ refers to a polyisobutene residue having an average molecular weight of 780.

EXAMPLE 7

Diesel fuel compositions 32 to 36 below were prepared comprising the additives listed in Table 6 below (the additives having been prepared by methods in accordance with Example 1). Diesel fuel composition 31 was prepared using Additive A above. The additives were added to aliquots all drawn from a common batch of RF06 base fuel and containing 1 ppm zinc (as zinc neodecanoate). The base fuel used was from a different batch to that used in tests described above and gave lower surface carbon in the HLPS test.

TABLE 5

| Fuel Comp'n | Additive | Treat rate ppm | Surface carbon $\mu g/cm^2$ |
|---|---|---|---|
| 26 (comp) | 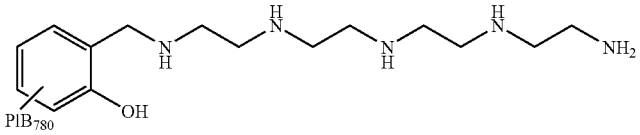 | 132 | 93 |
| 27 (comp) | 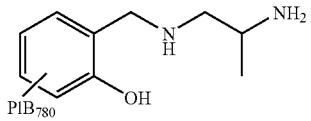 | 48 | 169 |
| 28 (comp) | 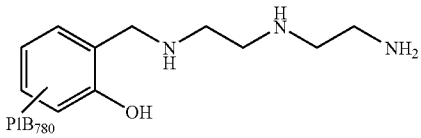 | 48 | 113 |
| 29 (comp) | 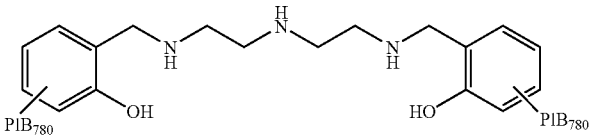 | 48 | 120 |
| 30 (inv) | 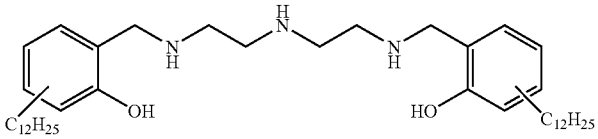 | 48 | 23 |
| 31 (inv) | 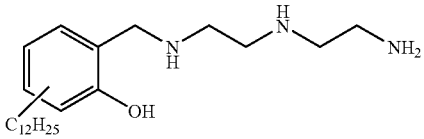 | 48 | 14 |
| 32 (inv) | 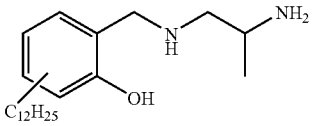 | 48 | 22 |

Each of the fuel compositions was tested using the Hot Liquid Process Simulator (HLPS) equipment described in Example 3.

TABLE 6

| Fuel comp'n | Phenol | Amine | Molar ratio HCHO:Amine: Phenol | Treat Rate Active ppm | Surface Carbon μg/cm$^2$ |
|---|---|---|---|---|---|
| 33 (ref) | — | — | — | 0 | 58 |
| 34 (comp) (Additive A) | — | — | — | 48 | 52 |
| 35 (inv) (Additive C) | P1 | A1 | 2:1:2 | 12 | 8 |
| 36 (inv) | P1 | A2 | 3:1:3 | 12 | 14.5 |
| 37 (inv) | P1 | A3 | 2:1:2 | 12 | 2.7 |
| 38 (inv) | P1 | A4 | 2:1:2 | 12 | 7.5 |
| 39 (comp) | P2 | A1 | 2:1:2 | 12 | 66.5 |

Phenol P1: p-dodecylphenol
Phenol P2: phenol substituted with polyisobutene of MW780
Amine A1: tetraethylenepentamine (TEPA)
Amine A2: tris (2-amino-ethyl)amine (TREN)
Amine A3: ethylenediamine (EDA)
Amine A4: aminoethylethanolamine (AEEA)

EXAMPLE 8

Unlike the tests described above, which are all quantitative tests, this example relates to qualitative tests, undertaken to provide a visual determination of the condition of fuel filters present under two different test regimes, a) comparative and b) in accordance with the invention.

a) The DW10 test method was applied, for 32 hours engine running time, using a batch of RF06 base fuel containing 1 ppm zinc (as zinc neodecanoate). A new fuel filter was used. At the end of the test period the fuel filter was removed and inspected, and was found to be heavily discoloured, with a coating of black residue on the filter surface.

b) The method was repeated, also for 32 hours engine running time, with a new fuel filter (but with the fuel injectors unchanged). The fuel was the same batch of RF06 diesel fuel, but contained 1 ppm zinc (as zinc neodecanoate), Additive A (192 ppm active) and Additive C (50 ppm). At the end of the test period the fuel filter was removed and inspected, and was found to be barely discoloured, with a cream colour filter surface.

EXAMPLE 9

Additive E was prepared using a method analogous to that described in example 1. In this case paraformaldehyde, ethylene diamine and 4-dodecyl phenol were reacted in a molar ratio of aldehyde (a):polyamine (b):phenol (c) of 2:1:2.

EXAMPLE 10

Additive F was prepared using a method analogous to that described in example 1. In this case paraformaldehyde, aminoethyl ethanolamine and 4-dodecyl phenol were reacted in a molar ratio of aldehyde (a):polyamine (b):phenol (c) of 2:1:2.

EXAMPLE 11

Diesel fuel compositions were prepared comprising the additives listed in Table 7, added to aliquots all drawn from a common batch of RF06 base fuel, and containing 1 ppm zinc (as zinc neodecanoate). These were tested according to the CEC DW 10 method, as detailed in relation to example 4. The power loss after running the engine for 32 hours was measured.

TABLE 7

| Fuel composition | Additive A (ppm active) | Additive E (ppm active) | Additive F (ppm active) | % power loss at 32 h |
|---|---|---|---|---|
| 40 (comp) | 96 | — | — | 6.6 |
| 41 (inv) | — | 121 | — | −2.0 |
| 42 (inv) | 96 | 25 | — | 3.9 |
| 43 (inv) | 96 | 50 | — | 0.3 |
| 44 (inv) | 96 | — | 50 | 0.2 |

The invention claimed is:

1. A method for improving the engine performance of a diesel engine with a high pressure fuel system comprising adding a compound to diesel fuel to form a diesel fuel composition, wherein the compound is the product of a Mannich reaction between;

(a) formaldehyde;

(b) a polyamine having 2 to 15 nitrogen atoms selected from the group consisting of ethylenediamine, diethylenetriamine, triethylenetetramine, tetraethylenepentamine, pentaethylenehexamine, hexaethyleneheptamine, heptaethyleneoctamine, propane-1,2-diamine, 2(2-amino-ethylamino)ethanol, $N^1$,$N^1$-bis(2-aminoethyl) ethylenediamine($N(CH_2CH_2NH_2)_3$, mixtures thereof, isomers thereof and oligomers thereof; and (c) an alkyl substituted phenol, wherein the or each substituent of component (c) has an average molecular weight of less than 300 and molecules of the Mannich reaction product have an average molecular weight of less than 2000; and combusting said diesel fuel composition in said diesel engine; wherein the engine has a pressure in excess of 1350 bar; and wherein the improvement in performance is measured by one or more of:

(i) a reduction in power loss of the engine;

(ii) a reduction in deposits on the injectors of the engine;

(iii) a reduction in deposits in the vehicle fuel filter; or (iv) an improvement in fuel economy.

2. The method of claim 1, wherein the compound has a molecular weight of less than 1000.

3. The method of claim 1, wherein component (c) is an alkyl-substituted phenol which is monosubstituted at the para-position.

4. The method of claim 1, wherein component (c) has a C12 alkyl substituent.

5. The method of claim 1, wherein the compound includes molecules of the formula:

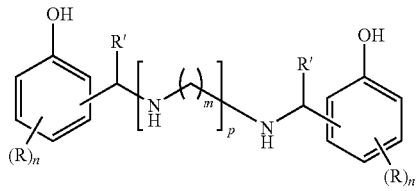

wherein each R is independently selected from an optionally substituted alkyl group and each R may be the same or different, R' is a residue from aldehyde component (a), n is from 0 to 4, m is from 1 to 6 and p is from 1 to 12.

6. The method of claim 1, Wherein the compound includes molecules of the formula:

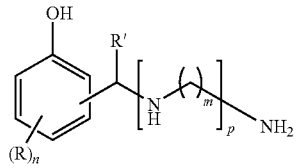

wherein each R is independently selected from an optionally substituted alkyl group and each R may be the same or different, R' is a residue from aldehyde component (a), n is from 0 to 4, m is from 1 to 6 and p is from 1 to 10.

7. The method of claim 1, wherein the compound is present in the diesel fuel composition in an amount from 0.01 to 100 ppm.

8. The method of claim 1, further comprising adding a nitrogen containing detergent to the diesel fuel composition.

9. The method of claim 1, wherein the or each substituent of component (c) has a molecular weight of 150 to 250.

10. The method of claim 1, wherein the or each substituent of component (c) has a molecular weight of 150 to 200.

* * * * *